US006288698B1

(12) United States Patent
Ishii et al.

(10) Patent No.: US 6,288,698 B1
(45) **Date of Patent: *Sep. 11, 2001**

(54) APPARATUS AND METHOD FOR GRAY-SCALE AND BRIGHTNESS DISPLAY CONTROL

(75) Inventors: Takatoshi Ishii, Sunnyvale; Yonggab Park, Castro Valley, both of CA (US)

(73) Assignee: S3 Graphics Co., Ltd., Caymen Islands (KY)

( * ) Notice: Subject to any disclaimer, the term of this patent is extended or adjusted under 35 U.S.C. 154(b) by 0 days.

This patent is subject to a terminal disclaimer.

(21) Appl. No.: 09/167,905

(22) Filed: Oct. 7, 1998

(51) Int. Cl.[7] ..... G09G 3/36

(52) U.S. Cl. ..... 345/87; 345/204; 345/112; 345/147; 345/153; 348/714; 348/715; 348/716

(58) Field of Search ..... 345/204, 87, 511, 345/112, 147–149, 153–155; 348/714–716

(56) References Cited

U.S. PATENT DOCUMENTS

| | | | | |
|---|---|---|---|---|
| 5,196,839 | | 3/1993 | Johary et al. | 345/148 |
| 5,293,159 | | 3/1994 | Bassetti, Jr. et al. | 345/149 |
| 5,552,800 | | 9/1996 | Uchikoga et al. | 345/89 |
| 5,805,126 | * | 9/1998 | Bassetti | 345/89 |
| 6,008,794 | * | 12/1999 | Ishii | 345/150 |
| 6,078,361 | * | 6/2000 | Reddy | 348/558 |

* cited by examiner

*Primary Examiner*—Bipin Shalwala
*Assistant Examiner*—Jimmy H. Nguyen
(74) *Attorney, Agent, or Firm*—Carr & Ferrell LLP

(57) ABSTRACT

Frame-rate control electronic provides gray-scale display control algorithm for STN LCD devices and constant brightness display with randomized pattern algorithm. Even distribution control of phase number reduces screen flicker and stabilizes gray-scale display. Randomized and scrambled phase number control eliminates screen beating artifacts, such as when image includes dither and checker patterns. Programmable parameters, such as tuning value, phase number matrices, and frame offset numbers, may be chosen flexibly to optimize conditions to certain display.

18 Claims, 7 Drawing Sheets

| | FRAME NUMBER (FC) | | | | | | | | | | | | | | | |
|---|---|---|---|---|---|---|---|---|---|---|---|---|---|---|---|---|
| FI | 0 | 1 | 2 | 3 | 4 | 5 | 6 | 7 | 8 | 9 | 10 | 11 | .. | .. | 254 | 255 |
| 0 | off | off | off | off | off | off | off | off | off | off | off | off | .. | .. | off | off |
| 1 | 0 | 1 | 2 | 3 | 4 | 5 | 6 | 7 | 8 | 9 | 10 | 11 | .. | .. | 254 | 255 |
| 2 | 0 | 2 | 4 | 6 | 8 | 10 | 12 | 14 | 16 | 18 | 20 | 22 | .. | .. | 252 | 254 |
| | 1 | 3 | 5 | 7 | 9 | 11 | 13 | 15 | 17 | 19 | 21 | 23 | | | 253 | 255 |
| 3 | 0 | 3 | 6 | 9 | 12 | 15 | 18 | 21 | 24 | 27 | 30 | | | | 250 | 253 |
| | 1 | 4 | 7 | 10 | 13 | 16 | 19 | 22 | 25 | 28 | 31 | .. | .. | .. | 251 | 254 |
| | 2 | 5 | 8 | 11 | 14 | 17 | 20 | 23 | 26 | 29 | 32 | | | | 252 | 255 |
| .. | | | | | | | | | | | | | | | | |
| .. | | | | | | | | | | | | | | | | |
| 6 | 0 | 6 | 12 | 18 | 24 | 30 | | | | | | | | | 244 | 250 |
| | 1 | 7 | 13 | 19 | 25 | 31 | | | | | | | | | 245 | 251 |
| | 2 | 8 | 14 | 20 | 26 | 32 | .. | .. | .. | .. | .. | .. | .. | | 246 | 252 |
| | 3 | 9 | 15 | 21 | 27 | 33 | | | | | | | | | 247 | 253 |
| | 4 | 10 | 16 | 22 | 28 | 34 | | | | | | | | | 248 | 254 |
| | 5 | 11 | 17 | 23 | 29 | 35 | | | | | | | | | 249 | 255 |
| .. | | | | | | | | | | | | | | | | |
| .. | | | | | | | | | | | | | | | | |
| 128 | 0 to 127 | 128 to 255 | 0 to 127 | 128 to 255 | 0 to 127 | 128 to 255 | 0 to 127 | 128 to 255 | 0 to 127 | 128 to 255 | 0 to 127 | 128 to 255 | | | 0 to 127 | 128 to 255 |
| .. | | | | | | | | | | | | | | | | |
| .. | | | | | | | | | | | | | | | | |
| 255 | all on | all on | all on | all on | all on | all on | all on | all on | all on | all on | all on | all on | all on | all on | all on | all on |

Fig. 5A

| SR36_5-3 | Dither Base Color | Dithered Base Position | Number of Bits to be Dithered | Number of Bits/Color |
|---|---|---|---|---|
| 000 | 7-0 | - | 0 | 8 |
| 001 | - | - | - | - |
| 010 | - | - | - | - |
| 011 | 7-5 | 4-1 | 4 | 3 |
| 100 | 7-4 | 3-0 | 4 | 4 |
| 101 | - | - | - | - |
| 110 | 7-2 | 1-0 | 2 | 6 |
| 111 | - | - | - | - |

Fig. 5B

| SR36_5-3 | Dither Base Color | Dithered Base Position | Number of Bits to be Dithered | Number of Bits/Color |
|---|---|---|---|---|
| 000 | 7-0 | - | 0 | 8 |
| 001 | - | - | - | - |
| 010 | - | - | - | - |
| 011 | 7-5 | 4-1 | 4 | 3 |
| 100 | 7-4 | 3-0 | 4 | 4 |
| 101 | - | - | - | - |
| 110 | 7-2 | 1-0 | 2 | 6 |
| 111 | 7-1 | 0 | 1 | 7 |

Fig. 5C

Dither bits: 0000
Pattern:

| | | | |
|---|---|---|---|
| 0 | 0 | 0 | 0 |
| 0 | 0 | 0 | 0 |
| 0 | 0 | 0 | 0 |
| 0 | 0 | 0 | 0 |

0001

| | | | |
|---|---|---|---|
| 1 | 0 | 0 | 0 |
| 0 | 0 | 0 | 0 |
| 0 | 0 | 0 | 0 |
| 0 | 0 | 0 | 0 |

0010

| | | | |
|---|---|---|---|
| 1 | 0 | 0 | 0 |
| 0 | 0 | 0 | 0 |
| 0 | 0 | 1 | 0 |
| 0 | 0 | 0 | 0 |

0011

| | | | |
|---|---|---|---|
| 1 | 0 | 1 | 0 |
| 0 | 0 | 0 | 0 |
| 0 | 0 | 1 | 0 |
| 0 | 0 | 0 | 0 |

Dither bits: 0100
Pattern:

| | | | |
|---|---|---|---|
| 1 | 0 | 1 | 0 |
| 0 | 0 | 0 | 0 |
| 1 | 0 | 1 | 0 |
| 0 | 0 | 0 | 0 |

0101

| | | | |
|---|---|---|---|
| 1 | 0 | 1 | 0 |
| 0 | 1 | 0 | 0 |
| 1 | 0 | 1 | 0 |
| 0 | 0 | 0 | 0 |

0100

| | | | |
|---|---|---|---|
| 1 | 0 | 1 | 0 |
| 0 | 1 | 0 | 0 |
| 1 | 0 | 1 | 0 |
| 0 | 0 | 0 | 1 |

0111

| | | | |
|---|---|---|---|
| 1 | 0 | 1 | 0 |
| 0 | 1 | 0 | 1 |
| 1 | 0 | 1 | 0 |
| 0 | 0 | 0 | 1 |

Dither bits: 1000
Pattern:

| | | | |
|---|---|---|---|
| 1 | 0 | 1 | 0 |
| 0 | 1 | 0 | 1 |
| 1 | 0 | 1 | 0 |
| 0 | 1 | 0 | 1 |

| Enable RGB DD | Red Row | Red Col | Green Row | Green Col | Blue Row | Blue Col |
|---|---|---|---|---|---|---|
| 0 | 0 | 0 | 0 | 0 | 0 | 0 |
| 1 | 0 | 3 | 0 | 0 | 3 | 0 |

Upper Bank

| | 0 | 1 | 2 | 3 |
|---|---|---|---|---|
| 0 | 0 | 13 | 4 | 9 |
| 1 | 11 | 6 | 15 | 2 |
| 2 | 14 | 3 | 10 | 7 |
| 3 | 5 | 8 | 1 | 12 |

Lower Bank

| | 0 | 1 | 2 | 3 |
|---|---|---|---|---|
| 0 | 0 | 11 | 6 | 9 |
| 1 | 7 | 4 | 13 | 2 |
| 2 | 12 | 15 | 10 | 5 |
| 3 | 3 | 8 | 1 | 14 |

Pattern RAM Address

| | 0 | 1 | 2 | 3 |
|---|---|---|---|---|
| 0 | 0 | 1 | 2 | 3 |
| 1 | 4 | 5 | 6 | 7 |
| 2 | 8 | 9 | 10 | 11 |
| 3 | 12 | 13 | 14 | 15 |

| Row \ Col. | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 0x16 | 208 | 32 | 112 | +13 | | | | +2 | 210 | 34 | 114 | +7 | | | |
| 1 | 80 | 128 | 240 | 160 | | | | | 82 | 130 | 242 | 162 | | | | |
| 2 | 192 | 16 | 96 | 48 | | | | | 194 | 18 | 98 | 50 | | | | |
| 3 | 144 | 64 | 172 | 224 | | | | | 146 | 66 | 174 | 226 | | | | |
| 4 | +5 | | | | +8 | | | | +15 | | | | +10 | | | |
| 5 | | | | | | | | | | | | | | | | |
| 6 | | | | | | | | | | | | | | | | |
| 7 | | | | | | | | | | | | | | | | |
| 8 | +12 | | | | +1 | 209 | 33 | 113 | +6 | | | | +3 | 211 | 35 | 115 |
| 9 | | | | | 81 | 129 | 241 | 161 | | | | | 83 | 131 | 243 | 163 |
| 10 | | | | | 193 | 17 | 97 | 49 | | | | | 195 | 19 | 99 | 51 |
| 11 | | | | | 145 | 65 | 173 | 225 | | | | | 147 | 67 | 175 | 227 |
| 12 | +9 | | | | +4 | | | | +11 | | | | +14 | | | |
| 13 | | | | | | | | | | | | | | | | |
| 14 | | | | | | | | | | | | | | | | |
| 15 | | | | | | | | | | | | | | | | |

Fig. 7A

| | | | |
|---|---|---|---|
| 0 | 13 | 2 | 7 |
| 5 | 8 | 15 | 10 |
| 12 | 1 | 6 | 3 |
| 9 | 4 | 11 | 14 |

Fig. 7B

| nP Output of New Coset Hash | Output of Upper Bank Phase Number 7-4 |
|---|---|
| 0000 | 0000 |
| 0001 | 1101 |
| 0010 | 0100 |
| 0011 | 1001 |
| 0100 | 1011 |
| 0101 | 0110 |
| 0110 | 1111 |
| 0111 | 0010 |
| 1000 | 1110 |
| 1001 | 0011 |
| 1010 | 1010 |
| 1011 | 0111 |
| 1100 | 0101 |
| 1101 | 1000 |
| 1110 | 0001 |
| 1111 | 1100 |

Fig. 7C

APPARATUS AND METHOD FOR GRAY-SCALE AND BRIGHTNESS DISPLAY CONTROL

FIELD OF INVENTION

Invention relates to computer graphics, particularly to electronics for controlling flat-panel display gray-scale and brightness.

BACKGROUND OF INVENTION

Super Twisted Nematic Liquid Crystal Displays (STN LCDs) are fundamentally binary devices for displaying gray scale by combining temporal modulation (e.g., Frame Rate Control (FRC)) and spatial modulation (e.g., dither) techniques. Since dither reduces spatial resolution, temporal modulation is preferred to produce gray scaling. However, temporal FRC approach for gray scale produces visual artifacts, such as flicker, due to temporal sensitivity of the human visual system (HVS). Accordingly there is need for achieving high quality, such as 256, gray level frame rate control in simple and elegant manner, thereby eliminating need for conventional spatial dither which introduces objectionable patterns.

In particular, such need would be especially appropriate to provide desired improvement over conventional brute-force approach to 256 gray-scale graphics processing, for example, wherein 256×256 weight table (i.e., corresponding to storing "1" or "0" for each of 256 frames (i.e., rows) and 256 gray levels (i.e., columns)) is ordinarily employed to achieve FRC digital signal processing.

SUMMARY OF INVENTION

Subject invention arises in electronic apparatus and signal processing method for gray scale and brightness display control, which effectively avoid use of weight table approach with frame rate control, particularly by generating specified phases (e.g., 256) of tiling pattern (e.g., 16×16) on-fly, preferably using 4×4 upper bank and 4×4 lower bank pattern memory. Row and column counts are provided in specified ("new") coset hash function which generates random phase used to index upper 4×4 pattern memory. Random phase may be scrambled using upper 4×4 pattern memory. Lower 4×4 pattern memory is provided by row and column counts to generate novel 256 phase number addressing scheme. Upper memory output is used as upper 4 most significant bit (msb) whereby output of lower memory are used, as lower 4 msb of 8-bit phase number. Such bit phase number is received by FRC data generator block for comparison to selected value range (e.g., as generated using frame count and data value,) to decide whether output bit is "1" or "0".

Preferably, such logic may be applied to upper and lower STN display areas for dual-scan panels. FRC data generator block is applied per primary color, i.e., one each for red, green, and blue. Red and blue FRC data generators may be identical to green, except that output is offset by adding red and blue offset, respectively, to frame count before use in FRC data generator, thereby providing even distribution of phase between red, green, and blue, pixels.

BRIEF DESCRIPTION OF DRAWINGS

FIG. 5A is a Phase Number (PN) turn-on table according to the present invention.

FIGS. 5B–C are a table of dithering data for TFT (Thin Film Transistor) and STN (Super Twisted Nematic) panels respectively according to the present invention.

FIGS. 7A–B are tables of representative phase number matrix output in 16×16 block unit and corresponding pattern memory matrix according to the present invention.

FIG. 7C is a scrambling look-up table and default values according to the present invention.

DETAILED DESCRIPTION OF PREFERRED EMBODIMENT

Figure 1A:
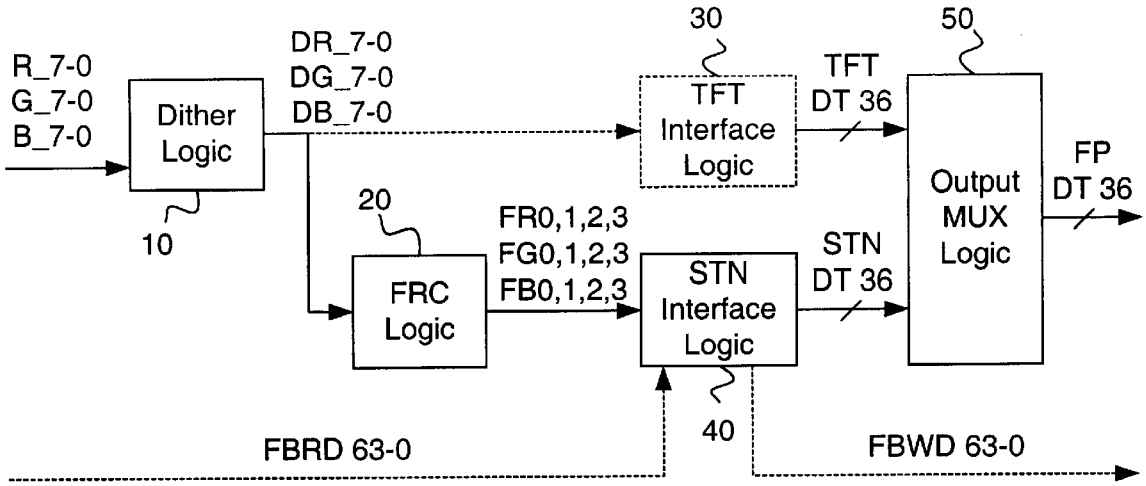
FIG. 1A is a block diagram of flat panel interface electronics and data flow according to the present invention.

Preferred embodiment is implemented in flat panel interface digital electronics and/or functionally equivalent firmware or software for gray-scaling digital graphic (e.g., image or video) data for computer screen display. Present data processing scheme improves conventional STN panel interface, and provides programmable architecture for tuning gray-scaling methodology to achieve quality display output. Present gray-scaling invention effectively achieves stable 256 gray-shade display using conventional-speed STN panels, and red/green/blue (RGB) associated frame control reduces screen flicker.

Generally, present circuit implementation and data processing methodology serves to control flat-panel display attributes, such as gray-scale and visual artifact parameters. FRC functionality provides gray-scale display processing of STN LCD-class screens. In particular, controls for RGB phase number and stable data output effectively reduce screen flicker and stabilize gray-scale display. Randomized and evenly distributed phase number control functionality eliminates screen beating artifacts, for example, when image includes dither and checker-like patterns. Programmable parameters, such as tuning values, pattern memory matrices, and frame offset (e.g., shift) numbers, may be chosen to optimize certain displays.

As described further herein, innovative FRC algorithm with RGB phase number control reduces screen flicker and stabilizes 256-gray scaling without using spatial dither logic in case of 256-gray scaling. In reduced gray-scaling, e.g., less than 256 gray levels, RGB distributed dithering with present FRC algorithm effectively smoothens gray-shade display, and RGB distributed dithering is applicable to TFT- and STN-type panels to smoothen pseudo 256 gray-shade display.

In accordance with an important aspect of present invention, to the extent STN LCD panels allow individual pixels to change ordinarily toward one of two brightness, i.e., on (white) or off (black), such panels may not display intermediate brightness levels between black and white, and, thus, FRC apparatus and technique provide gray-scale effect to observer. Present approach turns-on pixel for certain portion of frames and off for remaining portion, then such pixel effectively achieves intermediate gray-scale between on and off values. If adjacent pixels are turned on in same sequence according to frames undesirable visual disturbances may be observable; such problem may be suppressed by providing even interval between on and off in frames.

Using preferred approach, 24-bit/pixel data input are received, and 256 gray-scale FRC operation is performed with 256 frames. As described herein, 3 counters are used for frame, row, and column, including one randomizer (i.e., so-called New Coset Hash) for phase randomizing; two 4×4 pattern memory matrices for scrambling phase number and addressing scheme; three data generators for generating FRC output of RGB; and two frame offsets or shifters for frame shifting in RB (i.e., red and blue).

Generally, innovation accomplishes gray-scale display control for STN LCD and constant brightness display with associated even distribution of phase number. Instead of using weight table approach to generate FRC output data, preferred embodiment determines output by comparing frame number (FC), phase number (PN), and FRC input (FI) for red, green, and blue data signals. In particular, present approach omits use of weight table using extra memory, and generates output by comparing PN with critical regions, e.g., designated FX0 and FX1. Better signal processing flexibility is achieved with programmable tuning value, pattern memory matrices, and frame offset numbers to choose optimized conditions to given display.

FIG. 1A shows block diagram of flat panel interface electronics and data flow, preferably provided between system or graphics processor generating and/or receiving text, graphics, video, audio and/or other multi-media objects or data and output mechanism for displaying such text, graphical or other media content or other functionally equivalent computer screen or panel and associated interface electronics, firmware and/or software. Dither logic 10, which receives 8-bit RGB pixel data (R,G,B)_7-0 from external system source, generates data outputs, 8-bit RGB data D(R,G,B)_7-0, applicable to FRC logic 20 or TFT interface logic 30. FRC logic 20 receives incoming 8-bit RGB data and converts up to four sets of R,G,B single bit (i.e., each bit set for R,G,B) data (i.e., 12 bits total), F(R,G,B)(0,1,2,3), as described herein. STN interface logic 40 receives F(R,G,B)(0, 1,2,3) data.

When STN panel is so-called SS-type STN panel, F(R, G,B)0 data are packed in 4, 8, or 12 bits, depending on panel interface; and when STN panel is DD-type, F(R,G,B)1 data are packed and written to digital storage, such as frame memory. Data written in memory may be accessed in subsequent half frame cycle and merged with F(R,G,B)0 data and output as DD-STN display data; and data written may be fetched in parallel during write operation thereto and may be displayed at specified multiple of frame speed. Preferred display sequence of frame data is F(R,G,B)0, F(R,G,B)1, F(R,G,B)2, and F(R,G,B)3 with 4XE mode in 4 times of frame speed. TFT interface logic 30 receives 8-bit RGB data from dither logic 10, and packs such data into 18-bit to 36-bit and output as TFT display data, through output multiplexer logic 50, which selects STN display data from STN interface logic 40 or TFT display data depending on proper flat panel-type selection.

Dither logic 10 performs dithering on received pixel data, preferably independently of panel operation type; and dithering is applied independently of RGB data. Number of bits for dithering (i.e., representing dither base color) may be specified, for example, by designated variable, (e.g., so-called SR36_5-3 or equivalent variable,) as shown in FIGS. 5B–C. Hence, in case of TFT panels, SR36_5-3 programming may differentiate between 9-bit (i.e., 3-bit/color), 12-bit (i.e., 4-bit/color), 18-bit (i.e., 6-bit/color) and 24-bit (i.e., 8-bit/color) TFT panels, as shown in FIG. 5B.

Moreover, in case of STN type panel implementation, SR36_5-3 variable is programmed to choose one of five selection cases, as shown in FIG. 5C. Depending on bits in SR36_5-3, number of FRC bits/color, as shown in FIG. 5C, the 8 (i.e., 3-bit/color), 16 (i.e., 4-bit/color), 64 (i.e., 6-bit/color), 128 (i.e., 7-bit/color) or 256 (i.e., 8-bit/color) gray-scale FRC operation can be selected. Dither logic 10 may use 4-bit for dithering, based on addition process. For 2-bit dither, or when available dither bits are less than 4-bit, remaining least significant dither bits are set to zero values.

Note that 256 gray-scale in TFT or STN panel type requires 0 number of bits to be dithered with 8-bit in number of bits/color, as shown in FIGS. 5B–C. Accordingly, 256 gray-scaling with such algorithm in STN panel does not require dither logic operation with disabled dither function.

In case of TFT panel type implementation, dither base color (i.e., bits to dither,) as shown in FIG. 5B, are selected from most significant bits (msb) of input data to dither logic 10, and dithering carries are added to least significant bit (lsb) of dither base color; overflow carries are ignored. Dither logic 10 sets zero value on outputs bits not part of dither base color. For example, if base color bits are 7-5, then dither logic 10 output bits 4-0 may be set to zero values, and such output signals are sent to TFT interface logic 30.

In case of STN panel type implementation, FRC base color (i.e., bits to FRC,) as shown in FIG. 5C, are selected from most significant bits of input data and most significant four bits of remaining part (i.e., when there are less than 4-bit, data zeros are filled) are dithered in dither logic 10. Dithered carries are added to least significant bit of FRC base color; overflow carries of such addition are ignored. Dither logic 10 outputs added result of FRC base color to FRC logic 20. Dither logic 10 sets zeros on all outputs bits not part of FRC base color, except when added result of FRC base color becomes all ones. Accordingly, all ones 8-bit data may be output.

Figures 6A, 6B, 6C, 6D:
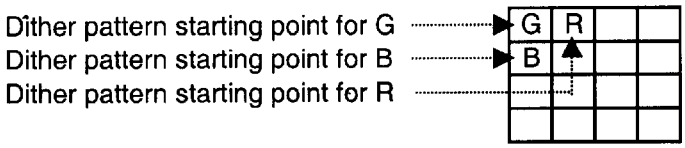
FIG. 6A is a display diagram of representative dithering pattern according to the present invention.
FIG. 6B is a display diagram of dither pattern origin point according to the present invention.
FIG. 6C is a table of dither pattern position control data according to the present invention.
FIG. 6D is a display diagram of programmable pattern generator default pattern memory matrices and pattern random access memory (RAM) address according to the present invention.

In FIG. 6A, basic 4×4 dither patterns are shown, where one (i.e., "1") indicates locations to be incremented. Only dither patterns for 0001 to 1000 are stored as data. Dither patterns for 1001 to 1111 are derived by inverting patterns for 0111 to 0001 correspondingly. Dither pattern for 0000 is fixed to all zeros. Such basic dither patterns are used preferably for Green data.

In FIG. 6B, representative dither pattern start origin point is shown. Top left corner is addressed when column counter is 00, and row counter is 00; such corner is referred to herein as "pattern origin point." Dither logic 10 effectively shifts starting position of pattern origin point for colors red and blue using above basic dither patterns to make RGB distributed dithering, i.e., instead of having each RGB dither pattern data. For example, when enable RGB distributed dither (EDD) signal is active, RGB dither pattern starting points are shifted, as shown in FIG. 6B.

Figure 2:
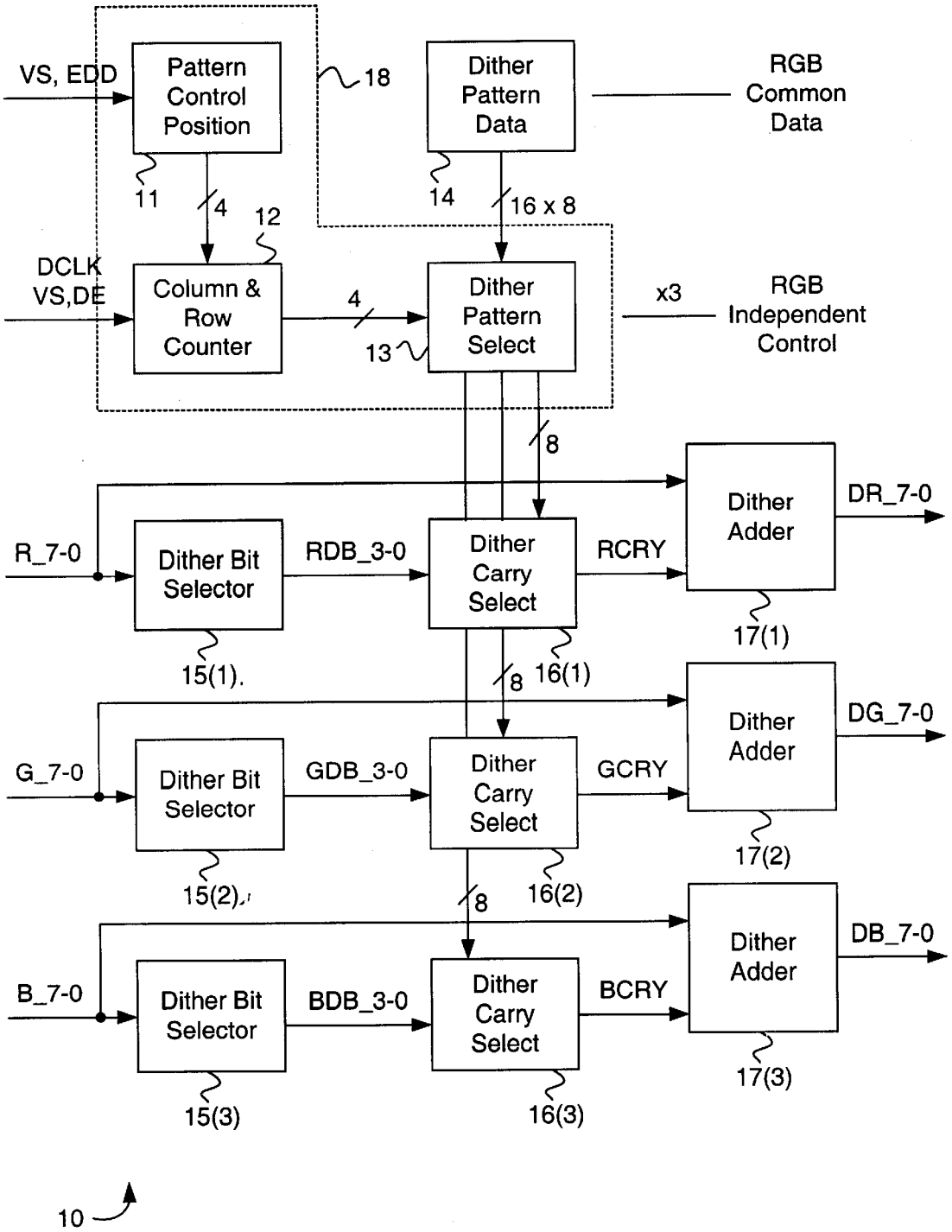
FIG. 2 is a block diagram of dither logic according to the present invention.

FIG. 2 shows preferred embodiment of dither logic 10. Dither pattern data 14 contain 16×8 (i.e., 8 of 4×4 matrix) basic dither patterns, except pattern for 0000; such patterns may be common data for RGB. Specified blocks 18 are prepared for each RGB to control independent dither start position, including pattern position control 11, column and row counter 12, and dither pattern select 13. Pattern position control 11 prepares frame start origin position of dither pattern RGB independently, and generates initial value of column and row counter 12.

Column and row counter 12 includes 2-bit column and 2-bit row counters. Row counter may be preset to frame start value at each frame start by vertical synchronization (VS) signal. Column counter is set to line start value at beginning of each line. Column counter counts data clock (DCLK), and row counter counts falling edge of display enable (DE) signal. Dither pattern select 13 selects 8-bit data from dither pattern data 14 specified by row and column position from column and row counter 12. FIG. 6C shows table of representative RGB row and column values, as generated by dither pattern position control 11 for frame and line start preset values of RGB row and column counters 12, depending on EDD mode.

Additionally, following operations by dither logic 10 are also RGB color independent and may proceed digital data processing in parallel: dither bit selector 15(1-3) selects 4-0 bits output specified by SR36_5-3 from 8-bit color input; and dither carry select 16(1-3) expands 8-bit dither pattern to 16-bit by inserting zero for 0000, and inverting incoming 8-bit data for 0111 to 0001 to generate data for 1001 to 1111 correspondingly. Then, dither logic 10 selects 1-bit from 16-bit data specified by 4-0 bits input color number, and outputs as color carry data.

Dither adder 17(1-3 ) receives 8-bit color input data and color carry data; dither adder 17(1-3) makes addition of such inputs. Adding bit position (i.e., least significant bit of dither base color) is specified by SR36_5-3. Result of addition may overflow, e.g., if dither base color is all ones. Dither adder 17(1-3) ignores overflow, and outputs incoming most significant bits for data output.

Figure 3:
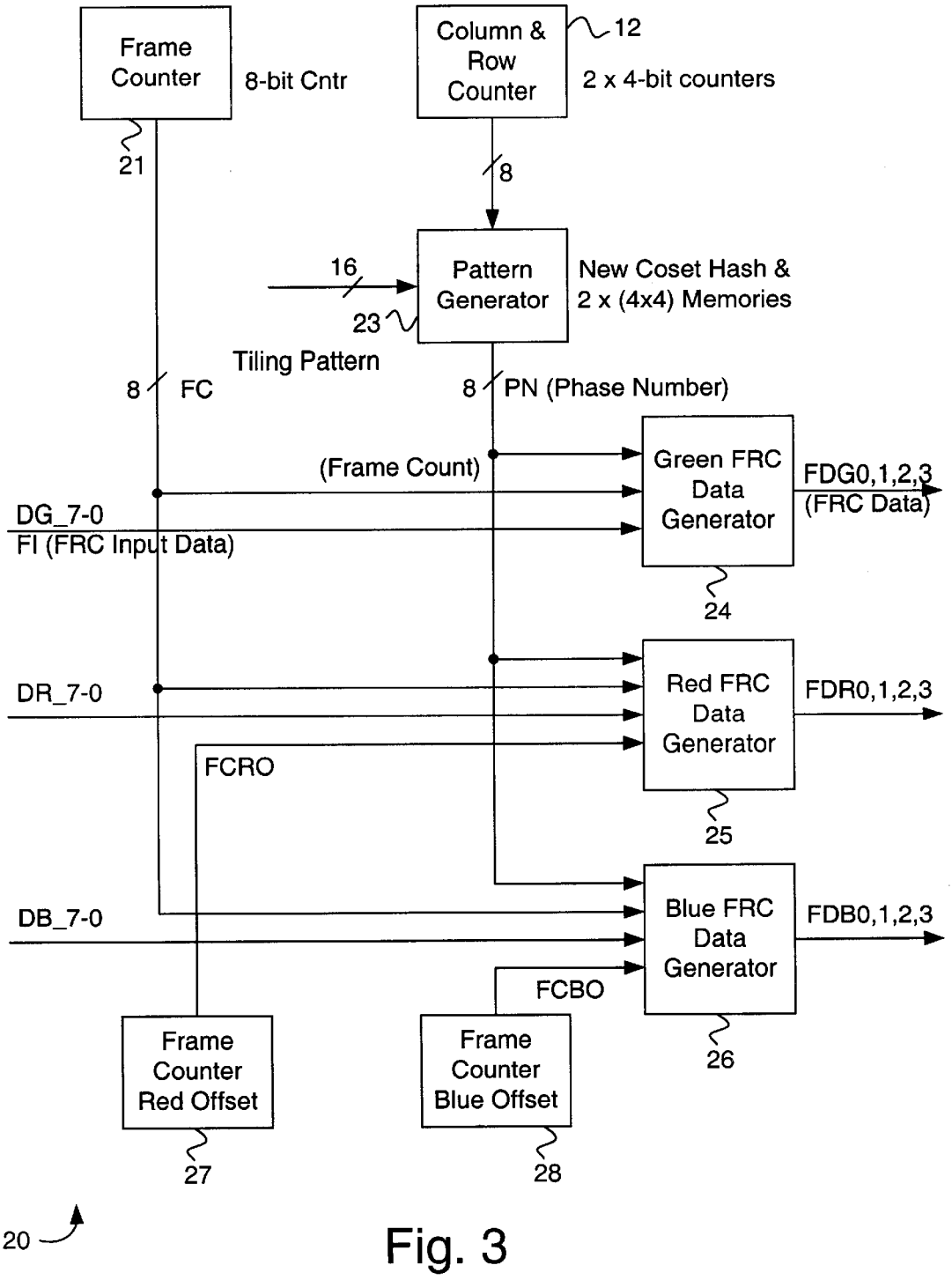
FIG. 3 is a block diagram of frame rate control logic according to the present invention.

In FIG. 3, 256 gray-scale FRC logic 20 receives dithered data (in 256 gray-scale case, with disabled dither function) and performs 256 gray-scale frame rate control processing. Generally, FRC logic uses 3 counters 12, 21 for row, column, and frame, and includes one randomizer (i.e., New Coset Hash function) for phase randomizing; two 4×4 pattern memory matrices for scrambling phase number and address scheme; three data generators 24, 25, 26 for generating FRC output of RGB; and two frame offsets or shifters for frame shifting in RB (i.e., red and blue). Note embodiment FRC logic 20 includes frame counter offsets 27, 28 with red and blue to achieve frame offset/frame shifting respectively, which further apply specified data: FCRO (Frame Counter Red Offset Value), FCBO (Frame Counter Blue Offset Value) respectively to red and blue FRC data generators 25, 26.

Figure 4A:
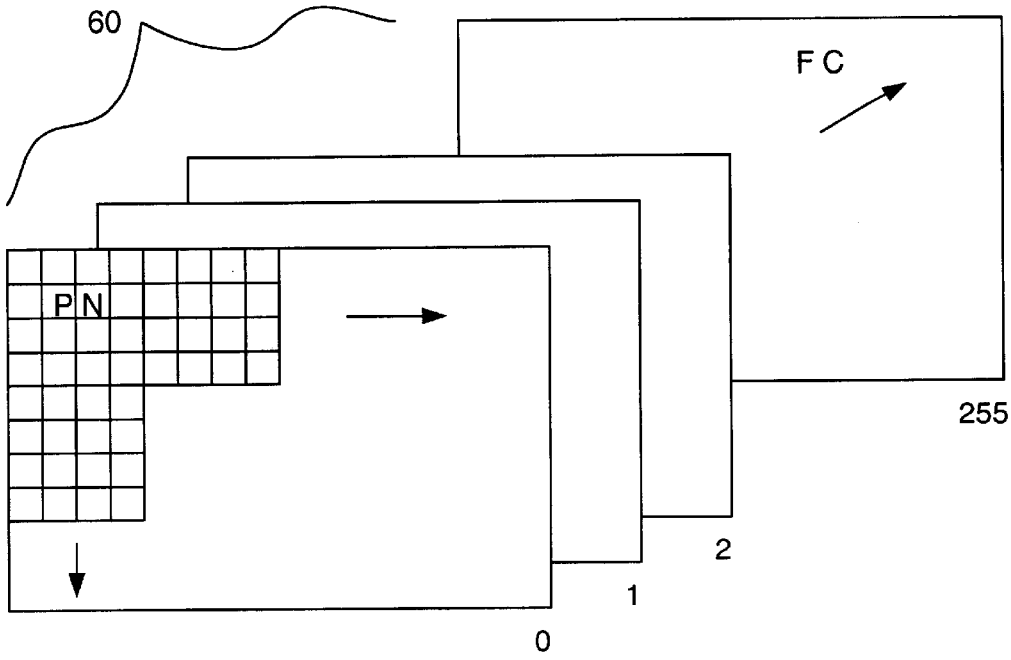
FIG. 4A is a frame diagram showing expanded by 16×16 phase number matrix and Frame Number (FC) according to the present invention.
Figure 4B:
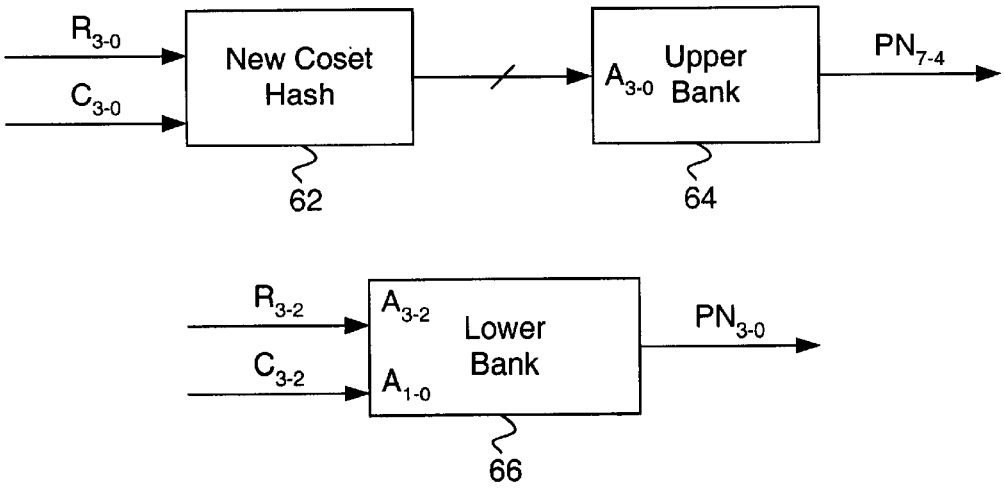
FIG. 4B is a block diagram of pattern generator memory addressing scheme according to the present invention.

Preferably, row and column counters 12 generate 4-bit numbers and frame counter 21 8-bit number respectively. New Coset Hash function 62 as shown in FIG. 4B receives two 4-bit input from row and column counters 12 to output 4-bit random base phase number, one of 0h to Fh. Such random base phase number is provided in one 4×4 pattern memory matrix 64, i.e., upper bank, and other pattern memory 66, i.e., lower bank, receives each 2-bit input from row and column counters 12. Such pattern memory matrices output scrambled phase number to improve randomness of phase number, and are expanded to create 256 phase number matrix having 00h to FFh. Frame offset data (FCRO and FCBO) 27, 28 shift number of frames in RB (i.e., red and blue) to distribute RGB data evenly on spatial and temporal frame domain. Data generators produce 1-bit/color FRC outputs of RGB by calculating and comparing phase number, offset frame count, and input data.

More particularly, depending on bits SR36_5-3, 8, 16, 64, 128, or 256 gray-scale FRC operation is selectable, and 8 bits/color input is received. Row and column counters 12 generate 4-bit counter numbers; such counters 12 specify current display pixel position for execution by FRC logic 20 in 16×16 block unit. Pattern generator 23 receives two (i.e., row and column) 4-bit counter numbers, and outputs 8-bit phase number, such output value being preferably from 00h to FFh. Frame count (FC) 21 is 8-bit counter, and counts from 00h to FFh (i.e., 256-count). FC for red and blue can be offset by each offset register data (i.e., by FCRO 27 and FCBO 28) in FRC data generator 25, 26.

FRC data generators 24, 25, 26 for RGB generate FRC data output (e.g., 1 bit/color, "1" or "0") by calculation, based on input data (e.g., FI-FRC Input Data) from dither logic 10, Frame Counter (FC) 21, Frame Counter Red Offset (FCRO) 27, Frame Counter Blue Offset (FCBO) 28, and Phase Number (PN). Following is sample pseudocode for implementing FRC data generator:

```
FRC Data Generator (FC, FI, PN){
if(FI == 0x00)      // if FRC input data == 0
    return 0;
else if(FI == 0xff)  // if FRC input data == 255
    return 1;
else{
    FX0=((FC+FCO)*FI)%256;      // FX0=(FC+FCO)*FI
    FX0=(FX0&0xff);             // mask every bits except least 8 bits
    FX1=FX0+FI;                 // FX1=FX0+FI
    if((FX1 & 0x100)==0x100){   // if carry is 1
        FX1=(FX1&0xff);         // mask every bits except least 8 bits
        if(FX0<=PN || PN<FX1)
            return 1;
        else
            return 0;
    }
    else{                       // if carry is 0
        if(FX0<=PN && PN<FX1)
            return 1;
        else
            return 0;
    }
}
}
where:
FCO = Frame Counter Offset Value for Red or Blue
```

In accordance with one aspect of present invention, even distribution of phase number may be used at spatial and/or temporal adjacent pixels to avoid undesirable visual disturbances, such as flickering, streaming, and screen beating. Even distribution of phase number involves randomized, scrambled, and offset distribution of phase number, and affects image quality of display. Hence, not only is balanced phase number used with randomizer, scrambler, and frame offset to improve balanced loading in spatial and temporal pixel relationship, but also present pattern memory addressing scheme creates well-balanced 256 phase number matrix. In this manner, well-balanced RGB phase number distribution is achieved among frames to provide smooth display in 256 gray-scale.

Thus, base PN values are determined per row and column counters representing display locations. Such counters determine base PN, one of 0h to Fh, through New Coset Hash randomizer, which may selectably program tuning value (or Tiling Pattern as shown in FIG. 3) to balance randomness in Pattern Generator 23. FRC processing performance is improved by such values, preferably tuned to adjust image quality; present process may be applied to 16×16 pixel area. With 16-bit programmable tuning value (or Tiling Pattern as shown in FIG. 3), random base phase of subject pixel is generated by New Coset Hash randomizer.

Generally, according to preferred embodiment, 256 PN matrix (00h to FFh) is created and tiled into entire frame by outputs from upper and lower banks as described herein. Specific pixel position (i.e., specific PN position) on 256 PN matrix is turned on or off to produce gray-scale effect in 16×16 pixel block according to frame number; frame counter counts from 00h to FFh (i.e., 256 frames). For example, FIG. 4A shows tiled 16×6 PN matrix to compose the entire frame and frame numbers (FC) 60. Additionally, FRC RGB data generators 24, 25, 26 generate outputs by calculating critical regions, FX0 and FX1, and comparing PN therewith. In particular, frame offset may be applied to provide even RGB intensity distribution among frames during FRC data generation. In this way, FRC flickering may be substantially reduced by compensating intensity in RGB.

Before calculating critical regions for PN, FC is offset by programmable frame-shifting numbers, e.g., FCRO and FCBO signals 27,28, to generate reduced flicker image display with even RGB intensity distribution among frames. Then, critical regions, FX0 and FX1, are calculated with FC and FRC Input (FI) Data for RGB. When PN is in range of FX0 and FX1, FRC Output Data, FD0, is turn on (i.e., "1") and off (i.e., "0") otherwise. Thus, FD0 is decided by comparing PN with FX0 and FX1. Second FRC Output Data, FD1, is generated by calculating FX2=FX1+FI and applying FX1 and FX2 to above methodology, instead of FX0 and FX1. Third and fourth FRC Output Data, FD2 and FD3, are generated by calculating FX3 and FX4 and applying methodology described herein.

Figure 1B:
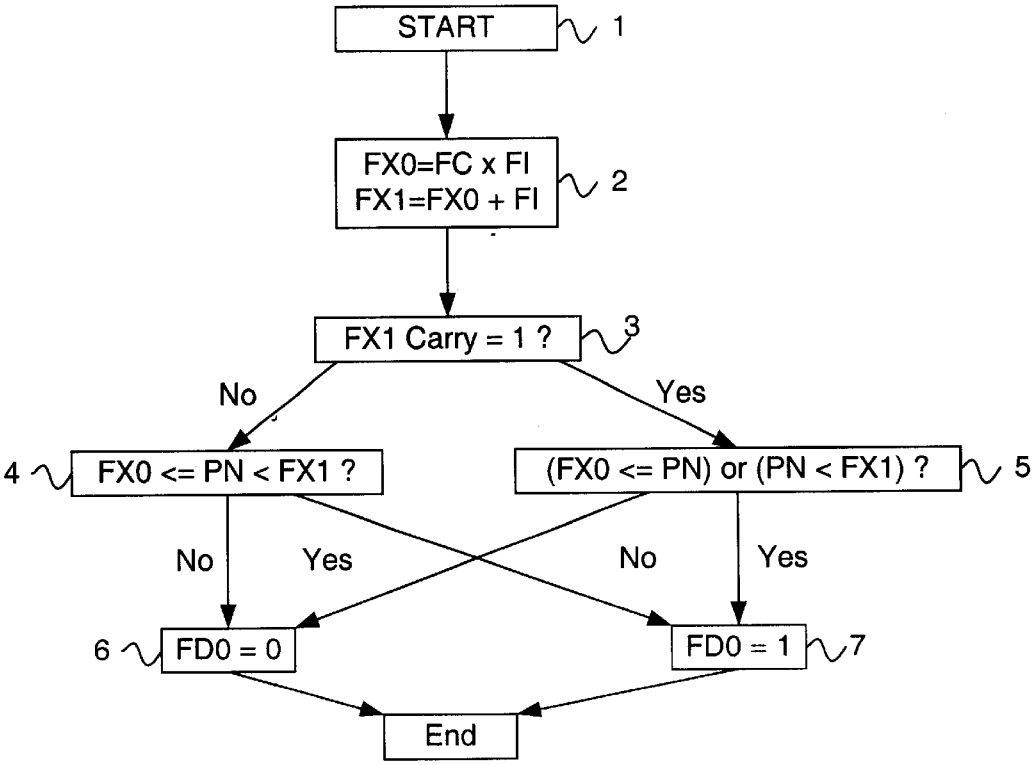
FIG. 1B is a flow diagram of frame rate control data generator according to the present invention.

FRC data generators 24, 25, 26 receive PN from pattern generator 23. PN value is preferably between 00h to FFh, and specifies sequence of turning on pixels in 16×16 block unit, which is same 16×16 block unit specified by row and column counters 12. PN is generated from 2 pattern memories and New Coset Hash randomizer. Output number PN is controlled effectively to be random by New Coset Hash function, and distribute evenly by pattern memory matrices to eliminate screen flicker and screen beating. Generally, FRC data generator 24, 25, 26 calculates values FX0 (FX0=FC×F1), and FX1 (FX1=FX0+FI), and compares with PN number. If PN is between FX0 and FX1, current pixel is activated or turned on. Furthermore, FIG. 5A shows representative PN turn-on table, and FIG. 1B shows flow diagram of FRC data generator 24, 25, 26 operation for generating FD(RGB)O signals, where:

FI=8-bit FRC Input Data for R, G, and B

FC=8-bit Frame Number after offset modification for R, G, and B

Offset Modification is: FC=FC+FCRO, and FC=FC+FCBO

FX0=8-bit Product Output of FC×FI; carry bit (bit 8) is ignored

FX1=8-bit Adder Output of FX0+FI; carry bit (bit 8) is used in next step

PN=8-bit Phase Number of current pixel position from pattern generator 23

FD0=One bit output for R, G, and B

Referring to FIG. 1B, as shown initially 1, FX0 and FX1 values are calculated 2, and then determine 3 whether FX1 carry is one value. If yes, then determine 5 if (FX0<=PN) or(PN<FX1); if not, then determine 4 if FX0<=PN<FX1. Hence, FD0 output data value is assigned to one or zero; e.g., FD1 may be generated by calculating FX2=FX1+FI and applying FX1 and FX2 accordingly, instead of FX0 and FX1. Moreover, FD2 and FD3 may be generated by calculating FX3 and FX4 and applying same methodology; three eight bit multipliers are used to calculate FX0=FC×FI for R, G, and B. In particular, 8-bit multiplier obtains simple sum of eight bit additions as follow:

$$
\begin{array}{lllllllllll}
FI_0\times & (FC_7 & FC_6 & FC_5 & FC_4 & FC_3 & FC_2 & FC_1 & FC_0) & = & FI\text{ bit }0\times FC \\
 & & & & + & & & & & & \\
FI_1\times & (FC_6 & FC_5 & FC_4 & FC_3 & FC_2 & FC_1 & FC_0 & 0) & = & FI\text{ bit }1\times FC \\
 & & & & + & & & & & & \\
FI_2\times & (FC_5 & FC_4 & FC_3 & FC_2 & FC_1 & FC_0 & 0 & 0) & = & FI\text{ bit }2\times FC \\
 & & & & + & & & & & & \\
FI_3\times & (FC_4 & FC_3 & FC_2 & FC_1 & FC_0 & 0 & 0 & 0) & = & FI\text{ bit }3\times FC \\
 & & & & + & & & & & & \\
FI_4\times & (FC_3 & FC_2 & FC_1 & FC_0 & 0 & 0 & 0 & 0) & = & FI\text{ bit }4\times FC \\
 & & & & + & & & & & & \\
FI_5\times & (FC_2 & FC_1 & FC_0 & 0 & 0 & 0 & 0 & 0) & = & FI\text{ bit }5\times FC \\
 & & & & + & & & & & & \\
FI_6\times & (FC_1 & FC_0 & 0 & 0 & 0 & 0 & 0 & 0) & = & FI\text{ bit }6\times FC \\
 & & & & + & & & & & & \\
FI_7\times & (FC_0 & 0 & 0 & 0 & 0 & 0 & 0 & 0) & = & FI\text{ bit }7\times FC \\
\hline
FX_7 & FX_6 & FX_5 & FX_4 & FX_3 & FX_2 & FX_1 & FX_0 & & = & FI\times FC
\end{array}
$$

where:

$FI_{7-0}$ = 8-bit FRC Input Data $FC_{7-0}$ = 8-bit Frame Number after offset modification $FX_{7-0}$ = 8-bit Product Output of $FI\times FC$; carry bit (bit 8) is ignored Referring back to FRC logic 20 in FIG. 3, pattern generator 23 generates PN for corresponding pixel position, wherein output is from 00h to FFh. PN specifies sequence of tuning on pixels in 16×16 pixel block, which is the same 16×16 pixel block specified by row and column counters. Pattern generator 23 has New Coset Hash randomizer 62 and two 4×4 pattern memory matrices (i.e., upper and lower banks 64, 66), as shown in FIG. 4B. Such banks 64, 66 may be read or written using specific registers. Default values of 4×4 pattern memory matrices and read/write matrix address are shown in FIG. 6D, wherein such matrices are read preferably when Display Enable (DE) is active and generates PN signal. Column and row counter 12 specifies pattern memory matrix address.

New Coset Hash function 62 with programmable tuning value generates random 4-bit address value for upper bank 64. Upper bank 64 output is left-shifted by 4 bits. Then, final PN is generated to create well-balanced 256 PN matrix by adding outputs from upper and lower banks. As sample case, FIG. 7A shows 16×16 PN matrix, which uses upper/lower pattern memory matrix, same as shown in FIG. 7B. Top-left corner 4×4 matrix has 16 times values of upper bank data. Other 15 (4×4) matrices have added values by lower bank data to top-left corner 4×4 values depending on position. PN value is determined as follows:

*PN* output value=(upper bank data)×16+(lower bank data)

Thus, balanced randomness of PN is accelerated effectively by 4×4 upper and lower banks scrambling matrices in pattern memory with proper phase selection from New Coset Hash randomizer In this way, 4×4 lower bank 66 in pattern memory may be provided by row and column counts to provide addressing scheme in 16×16 PN matrix.

Moreover, FRC tuning value, or tiling pattern, affecting display quality may be stored as 16-bit number in memory. Preferably, FRC methodology is applied to 16×16, or (((4×4)×4)×4) pixel area. In particular, with 16-bit tuning value ($T_0$- $T_{15}$), random base phase (one of 0h to Fh) of pixels may be generated by New Coset Hash function, called nP, generated from following equations:

$$nP_0=T_0C_2\oplus T_1C_3\oplus T_2R_2\oplus T_3R_3\oplus C_0$$

$$nP_1=T_4C_2\oplus T_5C_3\oplus T_6R_2\oplus T_7R_3\oplus C_1$$

$$nP_2=T_8C_2\oplus T_9C_3\oplus T_{10}R_2\oplus T_{11}R_3\oplus R_0$$

$$nP_3=T_{12}C_2\oplus T_{13}C_3\oplus T_{14}R_2\oplus T_{15}R_3\oplus R_1$$

where:

$nP_{3-0}$=4-bit phase $T_{15-0}$=16-bit programmable tuning value (tiling pattern)

$R_{3-0}$=4-bit row counter $C_{3-0}$=4-bit column counter

Preferably, 4-bit phase number from New Coset Hash 62 is provided in upper bank 64 in pattern memory to obtain "scrambled" $PN_{7-4}$. Scrambling of New Coset Hash 62 output is done using upper bank 64 of pattern memory (upper bank) matrix; upper bank matrix is used as scrambling look-up table and default value, for example, as shown in FIG. 7C. Such values are same as upper bank data described herein.

Foregoing described embodiments of the invention are provided as illustrations and descriptions. They are not intended to limit the invention to precise form described. In particular, Applicants contemplate that functional implementation of invention described herein may be implemented equivalently in hardware, software, firmware, and/or other available functional components or building blocks. Additionally, it is contemplated herein that meaning of specified term "data" is extendible also to cover transmitted, displayed, processed and/or stored electronic signal(s) which include or represent such data in electromagnetic or digitized form. Other variations and embodiments are possible in light of above teachings, and it is thus intended that the scope of invention not be limited by this Detailed Description, but rather by claims following.

What is claimed is:

1. In a computer display system having a data source and a flat panel display, an apparatus coupled to the data source and the flat panel display, the apparatus comprising:

a frame control circuit, which received input data and applies a phase number operation to the input data to generate output data, the phase number operation comparing critical display regions in the display with phase numbers associated with the input data; and a display interface circuit, which receives the input data and provides the output data to a flat panel display;

wherein the critical display regions comprise regions produced by multiplying the input data and a frame number associated with the input data.

2. The apparatus of claim 1 wherein the flat panel display comprises a Super Twisted Nematic Liquid Crystal Display (STN LCD), wherein such flat panel display operates substantially as a constant intensity display.

3. The apparatus of claim 1 wherein the phase number operation is applicable according to one or more programmable parameters comprising: a tuning value, a pattern memory values provided in an upper bank or a lower bank, or a frame offset value.

4. The apparatus of claim 1 wherein the phase number operation comprises balancing substantially evenly one or more phase numbers associated with one or more pixels adjacent spatially or temporally to one or more subject pixels represented by the output data.

5. The apparatus of claim 4 wherein one or more of the phase numbers are determined according to a data intensity indication, a programmable variable indication, or a counter representing one or more locations in the flat panel display.

6. The apparatus of claim 4 wherein the frame control circuit comprises a randomizer for generating a balanced phase number.

7. The apparatus of claim 6 wherein the phase number is balanced substantially between a frame sequence and an adjacent pixel corresponding to a frame associated with the output data.

8. The apparatus of claim 1 wherein the phase number operation comprises a pattern memory addressing the received input data to generate a phase number matrix for generating the output data.

9. The apparatus of claim 1 wherein the display interface circuit comprises a multiplexer for coupling to the flat panel display.

10. In a graphics system comprising a data source and a screen display, a signal processing method comprising the steps of:

receiving an input from a data source;

determining critical display regions by multiplying the input data and a frame number associated with the input data;

applying a phase number operation to the input data, the phase number operation comprising a step of comparing critical display regions in the display with the phase numbers associated with the input data; and providing a phase number output to a display screen.

11. The method of claim 10 wherein the display screen comprises a Super Twisted Nematic Liquid Crystal Display (STN LCD), wherein such display screen is operable substantially as a constant intensity display.

12. The method of claim 10 wherein the phase number operation is programmable according to a tuning value, a pattern memory value, or a frame offset value.

13. The method of claim 10 wherein the phase number operation comprises balancing substantially evenly one or more phase numbers associated with one or more pixels adjacent spatially or temporally to one or more subject pixels represented by the output data.

14. The method of claim 13 wherein the balancing uses a randomizer to provide a balanced phase number.

15. The method of claim 13 wherein one or more of the associated phase numbers are determined by a counter representing one or more locations in the display screen.

16. The method of claim 13 wherein the balancing is applied between a frame and an adjacent pixel for a frame associated with the output data.

17. The method of claim 10 wherein the phase number operation comprises addressing the base phase number using a pattern memory to generate a phase number matrix.

18. The method of claim 10 wherein the phase number output is provided to the display screen through a multiplexer.

* * * * *